US006332810B1

(12) United States Patent
Bareel

(10) Patent No.: US 6,332,810 B1
(45) Date of Patent: Dec. 25, 2001

(54) MODULAR TELECOMMUNICATION JACK-TYPE CONNECTOR WITH CROSSTALK REDUCTION

(75) Inventor: Baudouin Charles Francis Denis Marie Bareel, Brussels (BE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 09/692,046

(22) Filed: Oct. 20, 2000

(30) Foreign Application Priority Data

Oct. 29, 1999 (EP) ..... 99402703

(51) Int. Cl.[7] ..... H01R 24/00
(52) U.S. Cl. ..... 439/676; 439/941
(58) Field of Search ..... 439/676, 941, 439/344

(56) References Cited

U.S. PATENT DOCUMENTS 5,556,307 9/1996 Johnston ..... 439/676
5,713,764 2/1998 Brunker et al. ..... 439/636
5,716,237 2/1998 Conorich et al. ..... 439/660
5,915,989 6/1999 Adriaenssens et al. ..... 439/404
5,938,479 8/1999 Paulson et al. ..... 439/676
5,967,828 10/1999 Geurts et al. ..... 439/418
6,186,834 * 2/2001 Arnett et al. ..... 439/676

FOREIGN PATENT DOCUMENTS 0 692 884 A1 1/1996 (EP) .
2 298 974 A 9/1996 (GB) .

* cited by examiner

*Primary Examiner*—Tulsidas Patel
(74) *Attorney, Agent, or Firm*—Sughrue Mion, PLLC

(57) ABSTRACT

A modular telecommunication jack comprising contact terminals and a crosstalk compensation arrangement. The crosstalk compensation arrangement is constituted by parallel metallic plates (P4, P6) connected to a spring beam contact portion (S4, S6) of the terminals and allowed to slide in grooves (G4, G6) of the housing (5) of the jack according to the displacement of the contact portions. The crosstalk compensation arrangement is thus located very close to the contact point between the terminals of the jack and of the plug connected thereto. This location is optimal for reaching the Category 5 and even the Category 6 specification.

5 Claims, 2 Drawing Sheets

MODULAR TELECOMMUNICATION JACK-TYPE CONNECTOR WITH CROSSTALK REDUCTION

BACKGROUND OF THE INVENTION

The present invention relates to a modular telecommunication jack-type connector, hereafter merely called jack, generally used in telecommunication systems in association with a mating plug-type connector. The modular plug and jack combination is one of the principal components in a cabling system. A 8-pin modular combination comprising a well known RJ-45 male connector or plug as well as a RJ-45 female connector or jack is for instance standardized (I.E.C. 60603) or drafted for both the "Category 5" and "Category 6" connections, i.e. for transmission frequencies of up to 100 MHz and 200 MHz respectively. In these cases, incidence of electrical characteristics, particularly crosstalk effects such as the Near End CrossTalk or NEXT—, is relatively higher at the connections than in other parts of the cabling. The contact wires in the jack and in the plug are the major performance culprits, and the jack is usually designed to compensate these shortcomings. In other words, the jack has to compensate for imbalance created by the electrical contacts both in the plug and in this jack. To this end, the jack includes a crosstalk compensation arrangement as will be described in more detail below.

The present invention more particularly relates to a modular telecommunication jack-type connector comprising a dielectric housing means including a plug-receiving area, a plurality of terminals mounted on the housing means and a crosstalk compensation arrangement, the terminals of said plurality being mounted in parallel into said housing means and each terminal including a spring beam contact portion extending in cantilever fashion within the plug-receiving area, said contact portion having a first end extending to a curved base portion located in the housing means and being coupled to external connections of the modular connector, said crosstalk compensation arrangement comprising metallic plates connected to said terminals, wherein at least one other pair of terminals is associated to plates overlapping each other in parallel planes in order to define a physical capacitor between the associated other pair of terminals.

A classical method to compensating for the electrical anomalies caused by the split pair is the use of a printed board circuit. One or preferably more fixed capacitances are created, e.g. on a printed board circuit, to emulate a crossover effect. Such a jack is already known in the art, e.g. from the European Patent Application EP-A1-0 692 884 filed on Jul. 14, 1994 by MOLEX INCORPORATED (USA) and entitled "Modular connector with reduced crosstalk". Therein, the terminals have, between the first end of the contact portion and the external connection, an intermediate portion with enlarged sections forming metallic surfaces or plates. These surfaces are mounted on opposite sides of an insulating strip or plate creating so the physical capacitor(s) of the crosstalk compensation arrangement.

It is to be noted that other techniques like pair crossover or longitudinal capacitance are also classically used. These are for instance known from the UK Patent Application GB-A-2 298 974 filed on Mar. 14, 1996 by HUBBELL INCORPORATED (USA) and entitled "Crosstalk noise reduction connector for telecommunication system", or from the United States Patent U.S. Pat. No. 5,556,307 filed on Nov. 29, 1994 by THE WIREMOLD COMPANY (USA) and entitled "Modular telecommunication jack assembly". However, the crosstalk compensation obtained by the assemblies disclosed in these latter documents is relatively lower than that obtained by the assembly disclosed in the first mentioned document.

Category 5 specification for crosstalk performance is 40 dB at a frequency of 100 MHz, whilst for Category 6 this performance raises up to 54 dB. The main problem with the known assemblies or connectors is that, due to the higher performances asked for Category 6 with respect to Category 5, it is necessary to specify the plug performance additionally to the specification of the jack performance. It is thus necessary to specify very exact values also for the characteristics of the plug. Moreover, due to the close relationship between the plug and jack specification, the interoperability may not be guaranteed for Category 6 connectors of different productions. If low crosstalk plugs and jacks are designed as Category 6 products, then mating a Category 6 low crosstalk plug with a Category 5 jack can produce a connection that does not even meet Category 5 requirement, and vice versa.

SUMMARY OF THE INVENTION

An object of the present invention is to provide a modular telecommunication jack-type connector of the above known type but wherein the crosstalk compensation arrangement is adapted to easily reach the Category 6 or higher specification for any type or combination of modular connectors, e.g. of the RJ-45 type or any other connector with at least one pair of contact terminals.

According to the invention, this object is achieved due to the fact that the metallic plates of said crosstalk compensation arrangement are connected to a second end, opposite to said first end, of the spring beam contact portion of said terminals, and that the curved base portion of said terminals is directly connected to said external connections of said modular connector.

In this way, the crosstalk compensation arrangement is located very close to the contact point between the terminals of the plug and of the jack. This location is optimal for reaching the Category 6 specification with a broad range of plugs. Indeed, the known plug-jack combination can be seen as the series connection of the external terminals of the plug, the crosstalk compensation arrangement, the contact terminals of the plug, the contact terminals of the jack and external terminals thereof. On the other hand, in the present invention the plug-jack combination consists in the series connection of the external terminals of the plug, the contact terminals of this plug, the contact terminals of the jack and external terminals thereof, with the crosstalk compensation arrangement located over the contact terminals of both the plug and the jack. The present assembly, and more particularly the modular plug connector thereof is thus better adapted to give good results at relatively high frequencies.

Another characteristic feature of the present invention is that the parallel planes of said metallic plates are orthogonal to the plane formed by said plurality of terminals.

The metallic plates fixed to the spring beam contact portions of the terminals are then allowed to be displaced with respect to each other while avoiding to touch. Such displacements occur when the contact portions are bend in different ways by the contact terminals of the jack engaged in the present plug.

Also another characteristic feature of the present invention is that said metallic plates have different sizes.

In this way, some plates may be larger than necessary in order to obtain a same compensation, i.e. a same capacitive value, whatever the displacement of a contact portion with respect to another.

Still another characteristic feature of the present invention is that second ends of spring beam contact portions are crossed over each other prior to their connection to the associated metallic plates.

Physical capacitors can so be defined between different terminals, even if the latter are not adjacent neighbors.

Yet another characteristic feature of the present invention is that said metallic plates have different shapes.

Physical capacitors can so be defined between two non-adjacent metallic plates, i.e. when a third plate is located between them. The shape of the plates should then be so chosen that portions of the two plates can face each other without facing the third plate.

The present invention is further characterized in that said dielectric housing means comprises parallel grooves adapted to receive at least portions of said metallic plates, and in that said metallic plates are adapted to freely slide inside said grooves.

The dielectric characteristic of the housing means may then be chosen to achieve an optimal compensation.

BRIRF DESCRIPTION OF THE DRAWINGS

The above and other objects and features of the invention will become more apparent and the invention itself will be best understood by referring to the following description of an embodiment taken in conjunction with the accompanying drawings wherein.

DETAILED DESCRIPTION OF THE INVENTION

Figure 1:
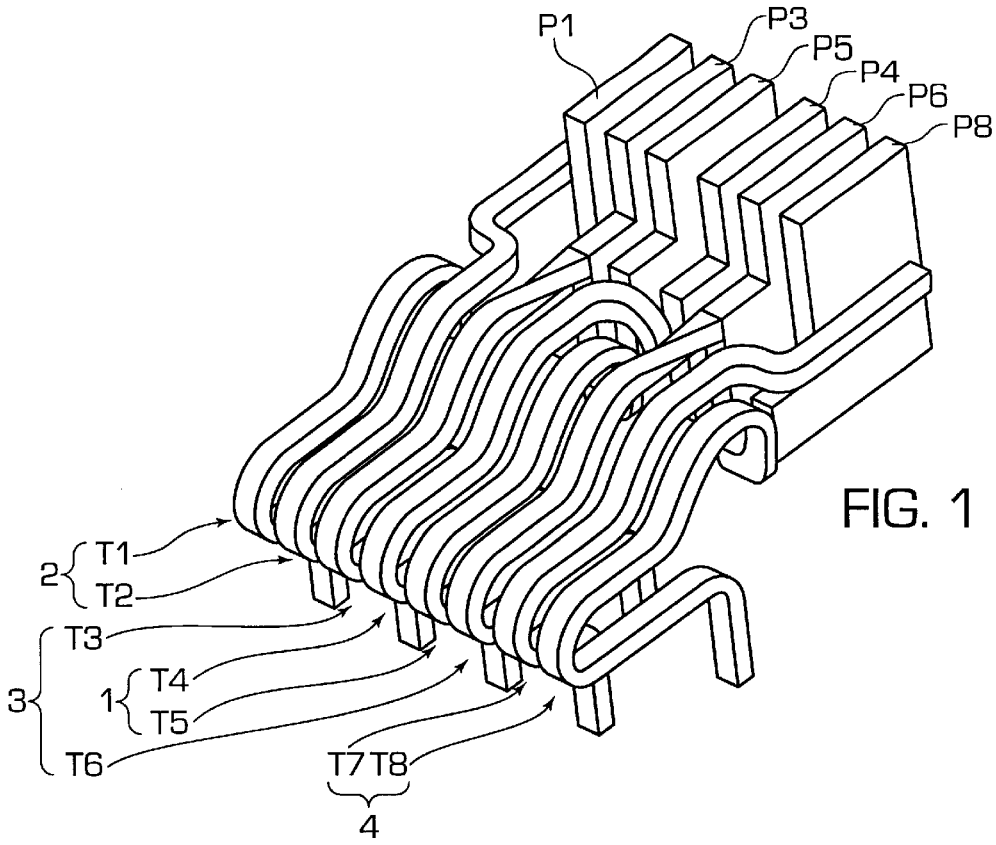
FIG. 1 represents contact terminals T1–T8 with a crosstalk compensation arrangement P1, P3, P5, P4, P6, P8 of a modular telecommunication jack-type connector according to the invention.

Contact terminals, generally referenced by the arrows T1, T2, T3, T4, T5, T6, T7 and T8, of a modular telecommunication jack-type connector, hereafter merely called jack, are shown at FIG. 1. The contact terminals T1 to T8 are parallel wires designed as short as possible and connected to pairs of wires external to the connector. A first pair 1 is connected to the terminals T4 and T5, a second pair 2 is connected to the terminals T1 and T2, a third pair 3 is connected to the terminals T3 and T6 and a fourth pair 4 is connected to the terminals T7 and T8. Most of these terminals, i.e. T1, T3, T4, T5, T6 and T8, are ended with metallic plates P1, P3, P4, P5, P6 and P8 respectively. The plates are metallic surfaces mounted in parallel to form physical capacitors with the purpose of reducing the well known crosstalk effect and more particularly the Near End CrossTalk, or NEXT, between the wires of different pairs. This crosstalk compensation is completed by further crossing the parallel wires near to their connection with the parallel plates. The crossed wires and parallel plates together form a crosstalk compensation arrangement that will be located as close as possible of the contact point between the jack and a plug to be connected thereto. Additionally to this optimal location of the crosstalk compensation, the choice in size and dimension of the plates, as well as the distance between them is calculated in order to obtain the best compensation.

Figure 2:
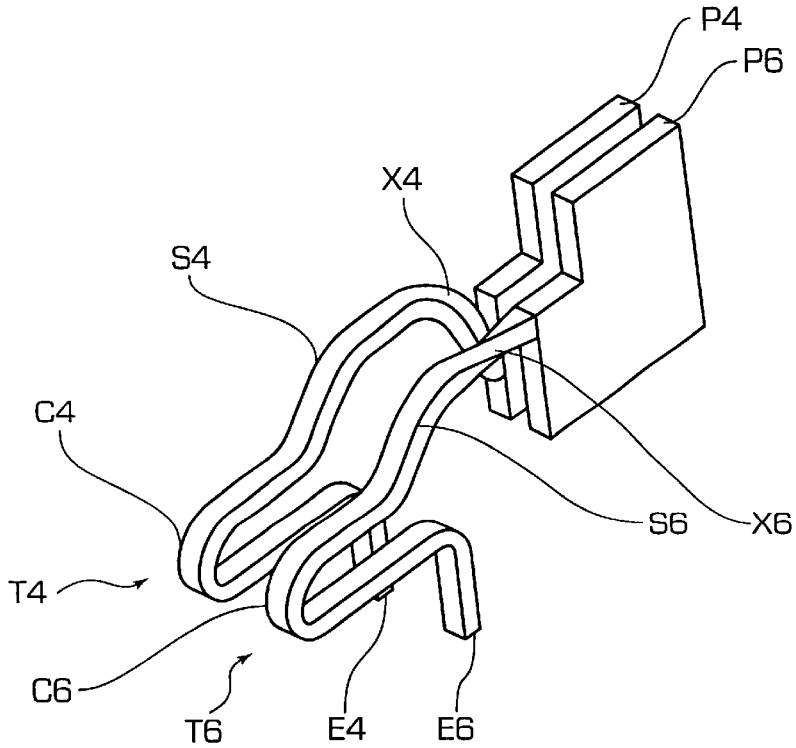
FIG. 2 represents in detail two T4, T6 of the eight contact terminals T1–T8 of FIG. 1.
Figure 3:
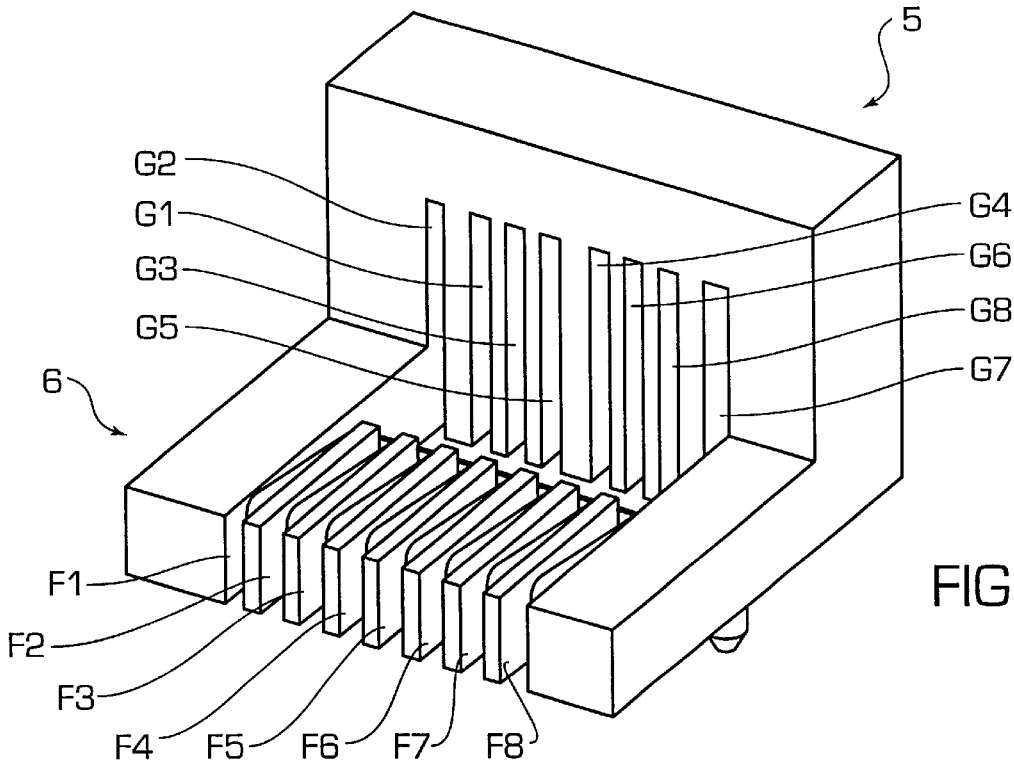
FIG. 3 represents a dielectric housing 5 for the terminals and crosstalk compensation arrangement of FIG. 1.

A jack with eight contact terminals T1–T8 is known in the telecommunication field as being of the RJ-45 type. To simplify the description of the contact terminals, only two of them say T4 and T6 belonging to different pairs of wires 1 and 3 are shown in detail at FIG. 2. The contact terminal T4/T6 has an external connection E4/E6 to which a wire of the pairs 1 and 3 is respectively connected. The external connection E4/E6 is connected to a curved base portion C4/C6 ending at a first end of a spring beam contact portion S4/S6 respectively. At the other end of the contact portions S4, S6, the wires T4, T6 cross each other and terminate with the respective metallic plates P4, P6. All the plates are located in parallel planes that are orthogonal to the plane formed by the contact portions of the set of terminals.

Figure 4:
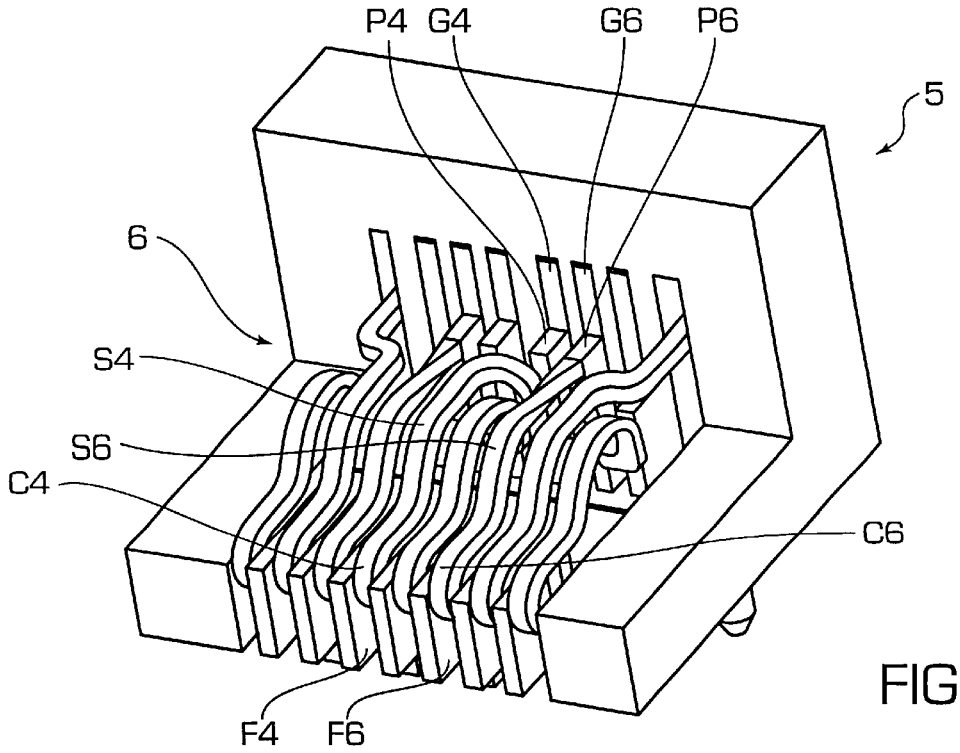
FIG. 4 represents the terminals T1–T8 and the crosstalk compensation arrangement of FIG. 1 mounted in the dielectric housing 5 of FIG. 3.

All the contact terminals T1 to T8 are mounted in a housing 5 as represented at FIG. 4. The housing 5 is a L-shaped piece dielectric material, preferably plastic, and comprises a set of grooves G2, G1, G3, G5, G4, G6, G8, G7 and a fixing system F1, F2, F3, F4, F5, F6, F7, F8 for receiving the contact terminals T1, T2, T3, T4, T5, T6, T7, T8 respectively. The lower internal side of the L-shaped dielectric housing 5 defines a plug receiving area 6 as will be described below.

The whole assembly of the contact terminals T1–T8 into the dielectric housing 5 is shown at FIG. 4. The contact terminals, e.g. T4/T6, are mainly fixed onto the fixing system F4/F6 of the dielectric housing 5 via their curved base portion C4/C6. The spring beam contact portions S4/S6 are mounted in cantilever fashion in the plug receiving area 6 so that the contact terminals are free to be displaced in a vertical plane. The metallic plates P4/P6 are, at least partially, engaged in corresponding grooves G4/G6 of the housing 5. The plates slide inside the grooves and remain parallel to get a stable compensation.

The plug receiving area 6 comprises the contact portions of all the contact terminals and is intended to receive corresponding contact terminals of a plug mating the present jack. Since the metallic plates are individually movable and slide freely into the grooves, and that the contact portions are upwardly bend, a good electrical contact is achieved between the jack and the plug connected thereto by insertion into the plug receiving area 6. Moreover, seeing that a tolerance is allowed on the vertical moving of the contact portions, some plates are bigger than necessary to obtain the same compensation whatever the vertical moving into the tolerances may be. Also the dielectric characteristic of the plastic used in the housing 5 is choose to get exactly the required compensation.

In a variant (not shown) of this embodiment, the metallic plates may have different shapes so that capacitors can also be defined between two nonadjacent plates. This is for instance the case when a third metallic plate is located between a first and a second metallic plate, with a size or shape that is smaller than that of the identical two first plates. The first and second plates may then be so designed that a first portion of any of them faces the third plate, whilst a second portion of them faces the other one of these two first plates, without facing the third plate. Physical capacitors are then created between the third and the first plate via the first portion thereof, between the third and the second plate via the first portion thereof, and between the first and the second plates via the second portions thereof. The crosstalk compensation arrangement may so be improved by affecting crosstalk between wires belonging to more that two pairs.

Although the principles of the invention have been described above in connection with a specific example of an 8-contacts standard connector, with only two contact terminals T4 and T6 explained in detail, the invention is nevertheless not limited thereto. It can obviously be applied to all other type of connector, whatever the number of contacts and for which a crosstalk and/or Near End CrossTalk—or NEXT'compensation is required.

What is claimed is:

1. Modular telecommunication jack-type connector comprising a dielectric housing means (5) including a plug-receiving area (6), a plurality of terminals (T1–T8) mounted on the housing means and a crosstalk compensation arrangement (P1, P3, P5, P4, P6, P8), the terminals of said plurality being mounted in parallel into said housing means and each terminal including a spring beam contact portion (S4, S6) extending in cantilever fashion within the plug-receiving area, said contact portion having a first end extending to a curved base portion (C4, C6) located in the housing means and being coupled to external connections (E4, E6) of the modular connector, said crosstalk compensation arrangement comprising metallic plates (P4, P6) connected to said terminals (T4, T6), wherein at least one other pair of terminals is associated to plates overlapping each other in parallel planes in order to define a physical capacitor between the associated other pair of terminals, wherein the metallic plates (P4, P6) of said cross talk compensation arrangement are connected to a second end (X4, X6), opposite to said first end (C4, C6), of the spring beam contact portion (S4, S6) of said terminals (T4, T6), and wherein the curved base portion of said terminals is directly connected to said external connections (E4, E6) of said modular connector.

2. Modular connector according to claim 1, wherein the parallel planes of said metallic plates (P4, P6) are orthogonal of the plane formed by said plurality of terminals (T4, T6).

3. Modular connector according to claim 1, wherein said metallic plates (P4, P6) have different sizes.

4. Modular connector according to claim 1, wherein said metallic plates (P4, P6) have different shapes.

5. Modular connector according to claim 1, wherein said dielectric housing means (5) comprises parallel grooves (G4, G6) adapted to receive at least portions of said metallic plates (P4, P6), and wherein said metallic plates are adapted to freely slide inside said grooves.

* * * * *